US009185948B2

(12) United States Patent
Ben-Arie

(10) Patent No.: US 9,185,948 B2
(45) Date of Patent: Nov. 17, 2015

(54) BUCKLE-LACE: LACE FASTENING DEVICE

(71) Applicant: Jezekiel Ben-Arie, Chicago, IL (US)

(72) Inventor: Jezekiel Ben-Arie, Chicago, IL (US)

( * ) Notice: Subject to any disclaimer, the term of this patent is extended or adjusted under 35 U.S.C. 154(b) by 49 days.

(21) Appl. No.: 14/164,778

(22) Filed: Jan. 27, 2014

(65) Prior Publication Data

US 2014/0208551 A1 Jul. 31, 2014

Related U.S. Application Data

(60) Provisional application No. 61/757,683, filed on Jan. 28, 2013, provisional application No. 61/806,954, filed on Apr. 1, 2013, provisional application No. 61/838,281, filed on Jun. 23, 2013, provisional application No. 61/859,304, filed on Jul. 29, 2013, provisional application No. 61/880,857, filed on Sep. 21, 2013.

(51) Int. Cl.
*A43C 7/04* (2006.01)

(52) U.S. Cl.
CPC ..... *A43C 7/04* (2013.01); *Y10T 24/3724* (2015.01)

(58) Field of Classification Search
CPC ..... A43C 7/00; A43C 1/00; A43C 11/00; A43C 11/165; A43C 11/20; A43C 7/08; Y10T 24/3713; Y10T 24/3716; Y10T 24/3724; F16G 11/10; A43B 11/00
USPC ..... 24/712.9, 712.5, 712.6
See application file for complete search history.

(56) References Cited

U.S. PATENT DOCUMENTS

| | | | | |
|---|---|---|---|---|
| 4,071,964 | A | 2/1978 | Vogiatzis | |
| 4,125,918 | A | 11/1978 | Baumann | |
| 4,130,949 | A | 12/1978 | Seidel | |
| 4,261,081 | A | 4/1981 | Lott | |
| 4,458,373 | A | 7/1984 | Maslow | |
| 4,477,947 | A * | 10/1984 | Lyons | F16G 11/00 24/115 F |
| 4,507,878 | A | 4/1985 | Semouha | |
| 4,616,432 | A | 10/1986 | Bunch | |
| 4,648,159 | A | 3/1987 | Dougherty | |
| 4,991,273 | A | 2/1991 | Huttle | |
| 5,001,847 | A | 3/1991 | Waters | |
| 5,029,371 | A * | 7/1991 | Rosenblood | A43B 3/0078 24/115 G |
| 5,097,573 | A | 3/1992 | Gimeno | |
| 5,109,581 | A | 5/1992 | Gould | |
| 5,119,539 | A | 6/1992 | Curry | |
| 5,177,882 | A | 1/1993 | Berger | |
| 5,203,053 | A | 4/1993 | Rudd | |
| 5,230,171 | A | 7/1993 | Cardaropoli | |
| 5,293,669 | A | 3/1994 | Sampson | |
| 5,293,675 | A | 3/1994 | Shai | |
| 5,295,315 | A | 3/1994 | Osawa | |

(Continued)

*Primary Examiner* — Robert J Sandy
*Assistant Examiner* — Rowland Do

(57) ABSTRACT

A device for fastening laces. The device includes a multiplicity of channels. Each channel has an upper part rotatably mounted on lower part and a resilient gate which is installed diagonally. The front ends of the gates are sharp and free to move. They can squeeze laces which pass through the gates' gaps with their opposite channel walls. The gap widths are controlled by a locking mechanism, which the user can activate by rotating the upper part relative to the lower part. When the gaps are narrowed, the gates squeeze the laces and act as lace ratchets i.e. allowing the laces to move only forwards. The ratchet operation enables the user to fasten the laces and they remain fastened as long as the locking mechanism is in locked position. When the locking mechanism is switched into opened position the gaps are widened and the laces are released.

16 Claims, 5 Drawing Sheets

(56) References Cited

U.S. PATENT DOCUMENTS

| | | | | |
|---|---|---|---|---|
| 5,335,401 | A | 8/1994 | Hanson | |
| 5,467,511 | A | 11/1995 | Kubo | |
| 5,477,593 | A | 12/1995 | Leick | |
| 5,572,774 | A | 11/1996 | Duren | |
| 5,572,777 | A | 11/1996 | Shelton | |
| 6,076,241 | A | 6/2000 | Borel | |
| 6,094,787 | A | 8/2000 | Chang | |
| 6,192,241 | B1 | 2/2001 | Yu | |
| 6,192,559 | B1 | 2/2001 | Munsell | |
| 6,282,817 | B1 | 9/2001 | Curet | |
| 6,334,240 | B1 | 1/2002 | Li | |
| 6,339,867 | B1 | 1/2002 | Azam | |
| 6,438,871 | B1 | 8/2002 | Culverwell | |
| 6,457,214 | B1 * | 10/2002 | Boden | F16G 11/10 24/115 M |
| 6,588,079 | B1 | 7/2003 | Manzano | |
| 6,622,358 | B1 | 9/2003 | Christy | |
| 6,729,000 | B1 | 5/2004 | Liu | |
| 6,735,829 | B2 | 5/2004 | Hsu | |
| 6,938,308 | B2 | 9/2005 | Funk | |
| 7,082,701 | B2 | 8/2006 | Dalgaard | |
| 7,152,285 | B2 | 12/2006 | Liao | |
| 7,313,849 | B2 | 1/2008 | Liu | |
| 7,320,161 | B2 | 1/2008 | Taylor | |
| 7,360,282 | B2 | 4/2008 | Borsoi | |
| 7,591,050 | B2 | 9/2009 | Hammerslag | |
| 7,681,289 | B2 | 3/2010 | Liu | |
| 7,946,007 | B2 * | 5/2011 | Borsoi | A43C 7/08 114/218 |
| 8,046,937 | B2 | 11/2011 | Beers | |
| 8,141,273 | B2 | 3/2012 | Stramare | |
| 8,230,560 | B2 | 7/2012 | Luzlbauer | |
| 8,231,074 | B2 | 7/2012 | Hu | |
| 8,332,994 | B2 | 12/2012 | Lin | |
| 8,371,004 | B2 * | 2/2013 | Huber | A43B 5/0401 24/132 R |
| 8,381,362 | B2 | 2/2013 | Hammerslag | |
| 2002/0002781 | A1 | 1/2002 | Bouirer | |
| 2003/0226284 | A1 | 12/2003 | Grande | |
| 2004/0187757 | A1 * | 9/2004 | Siewert | F16G 11/10 114/218 |
| 2005/0005477 | A1 | 1/2005 | Borsoi | |
| 2005/0034281 | A1 * | 2/2005 | Shiue | F16G 11/10 24/132 R |
| 2006/0213085 | A1 | 9/2006 | Azam | |
| 2007/0169380 | A1 | 7/2007 | Borsoi | |
| 2008/0250618 | A1 | 10/2008 | Stramare | |
| 2009/0172929 | A1 | 7/2009 | Hwang | |
| 2010/0115744 | A1 | 5/2010 | Fong | |
| 2011/0067211 | A1 * | 3/2011 | Huber | A43B 5/0401 24/712.1 |
| 2011/0094072 | A1 | 4/2011 | Lin | |

* cited by examiner

BUCKLE-LACE: LACE FASTENING DEVICE

CROSS-REFERENCE TO RELATED APPLICATIONS

This application claims the benefit of provisional patent applications:
Ser. No. 61/757,683 Filing Date: Jan. 28, 2013
Ser. No. 61/806,954 Filing Date: Apr. 1, 2013
Ser. No. 61/838,281 Filing Date: Jun. 23, 2013
Ser. No. 61/859,304 Filing Date: Jul. 29, 2013
Ser. No. 61/880,857 Filing Date: Sep. 21, 2013

FEDERALLY SPONSORED RESEARCH

Not Applicable

SEQUENCE LISTING OR PROGRAM

Not Applicable

FIELD OF THE INVENTION

The invention is related to devices for fastening laces, chords, ropes, strings and alike.

DESCRIPTION OF RELATED PRIOR ART

Many devices were invented for shoe lace tightening. The most commercially successful is U.S. Pat. No. 6,339,867 by Azam which is widely used in fastening laces of skiing and skates boots. The tightening principle is a spring loaded gear wheel which can move in wedge shaped passage which widens forwards and narrows backwards. The laces pass through that passage and can be fastened by pulling the laces forwards which in turn pulls forwards the gear wheel towards the wider part of the passage where the laces are free to move. When the pulling stops the laces pull the gear wheel backwards, which narrows the passage and blocks the laces' backwards motion. The laces can be released by pulling the gearwheel forwards with a knob. There are two small disadvantages to this invention. The device must be installed on heavy-solid footwear which eliminates its use with regular shoes and the user must constantly pull the knob to keep the releasing. Similar approach is taken in U.S. Pat. No. 7,360,282 by Borsoi and in U.S. Pat. No. 8,141,273 by Stramare. The lace buckle device described in U.S. Pat. No. 6,334,240 by Li is used widely in coat laces. It has a lace passage controlled by a spring loaded piston that blocks lace motion when the spring is released. Except for the similar name there is no similarity to our invention. This buckle controls only one lace and does not have a ratchet operation at all. When the user wants to release or fasten the lace the user has to press the spring loaded piston, release the lace and pull at the same time. When the spring is released, the buckle returns to blocking the lace. In U.S. Pat. No. 6,729,000 Liu uses for lace tightening a teethed rotating bar. In U.S. Pat. No. 6,076,241 by Borel and in several others such as in U.S. Pat. No. 6,622,358 to Christy and in U.S. Pat. No. 6,192,241 by Yu et al. use fastening devices which are based on pipes or channels which have diagonal teeth to block reverse motion of the lace. The pipes are installed on the shoes in different locations.

We have found many other inventions which dealt with the problem of lace fastening but none is similar to our invention. These inventions are listed here:

ADDITIONAL US PATENTS

U.S. Pat. No. 8,381,362 to Hammerslag et al. teaches Real based closure system. U.S. Pat. No. 8,332,994 to Lin teaches Shoelace with shoelace fastener. U.S. Pat. No. 8,141,273 to Stramare et al. describes Shoes with directional conditioning device for laces. U.S. Pat. No. 8,231,074 to Hu et al. describes Lace winding device for shoes. U.S. Pat. No. 8,230,560 to Luzlbauer teaches Fastening system for shoes.

U.S. Pat. No. 8,046,937 to Beers et al. describes an Automatic lacing system. U.S. Pat. No. 7,681,289 to Liu describes a Fastener for fasting together two lace systems. U.S. Pat. No. 7,591,050 to Hammerslag describes a Footwear lacing system. U.S. Pat. No. 7,320,161 to Taylor describes a Lace tying device, U.S. Pat. No. 7,313,849 to Liu describes a Fastener for lace. U.S. Pat. No. 7,152,285 to Liao describes a Shoe lace fastening device. U.S. Pat. No. 7,082,701 to Dalgaard describes Footwear variable tension lacing systems. U.S. Pat. No. 6,938,308 Funk describes a lace securing and adjusting device. U.S. Pat. No. 6,735,829 Hsu describes a U shaped lace buckle. In U.S. Pat. No. 6,588,079 to Manzano describes a Shoelace fastening assembly. U.S. Pat. No. 6,438,871 to Culverwell describes Footwear fastening. U.S. Pat. No. 6,192,559 to Munsell Jr. describes a Shoelace fastening apparatus. U.S. Pat. No. 6,094,787 to Chang describes a Fastening device. U.S. Pat. No. 5,572,777 to Shelton describes a Shoelace tightening device. U.S. Pat. No. 5,572,774 to Duren teaches a Shoe fastening attached device. U.S. Pat. No. 5,467,511 to Kubo describes a Shoelace fastening device. U.S. Pat. No. 5,335,401 to Hanson teaches a Shoelace tightening and locking device. U.S. Pat. No. 5,295,315 to Osawa et al. describes a Shoe fastening device and plate shaped member thereof. U.S. Pat. No. 5,293,675 to Shai describes a Fastener for shoelace. U.S. Pat. No. 5,293,669 to Sampson teaches a Multiuse fastener system. U.S. Pat. No. 5,230,171 to Cardaropoli teaches a Shoe fastener. U.S. Pat. No. 5,203,053 to Rudd teaches a Shoe fastening device. U.S. Pat. No. 5,177,882 to Berger teaches a Shoe with central fastener. U.S. Pat. No. 5,119,539 to Curry teaches a Lace fastener. U.S. Pat. No. 5,109,581 to Gould teaches a Device and method for securing a shoe. U.S. Pat. No. 4,991,273 to Huttle teaches Shoe lace fastening. U.S. Pat. No. 4,648,159 to Dougherty teaches a Fastener for lace or rope or the like. U.S. Pat. No. 4,616,432 to Bunch et al. teaches a Shoe upper with lateral fastening arrangement. U.S. Pat. No. 4,507,878 to Semouha teaches a Fastener mechanism. U.S. Pat. No. 4,458,373 to Maslow teaches Laced shoe and method for tying shoelaces. U.S. Pat. No. 4,261,081 to Lott teaches a Shoelace tightener. U.S. Pat. No. 4,130,949 to Seidel teaches Fastening means for sports shoes. U.S. Pat. No. 4,125,918 to Baumann teaches a Fastener for lace shoes. U.S. Pat. No. 4,071,964 to Vogiatzis teaches a Footwear fastening system. U.S. Pat. No. 5,097,573 to Gimeno teaches Fastening Device for Lace Up Shoes. U.S. Pat. No. 5,001,847 to Waters teaches a Lace Fastener. U.S. Pat. No. 5,477,593 to Leick teaches a Lace Locking Device. U.S. Pat. No. 6,282,817 to Curet teaches an Apparatus and Method for Lacing.

US PATENT APPLICATIONS

In US 2011/0094072 to Lin describes a Shoelace with Shoelace Fastener. In US 2010/0115744 to Fong describes a Lace Fastener. In US 2009/0172929 to Huang describes a Device for tying Shoelaces. In US 2008/0250618 to Stramare describes a Shoe with Directional Conditioning Device for lace or the like. In US 2007/0169380 to Borsoi teaches a Device for Blocking Flexible Strands. In US 2006/0213085 to Azam teaches an Article for Footware with Linkage Tightening Device. In US 2005/0005477 to Borsoi teaches a Lace Blocking Device. In US 2003/0226284 to Grande teaches a Lacing System For Skates. In US 2002/0002781 to Bourier teaches a Lace Tightening Device Having a Pocket for Storing A Blocking Element.

None of the Patents and Patent applications described above is similar to our invention.

BRIEF SUMMARY OF THE INVENTION

The invention is a device called Buckle-Lace Fastening Device (BLFD) which enables easy fastening and keeping fastened of: laces, ropes, strings and alike. The device is small in dimensions and can be installed on shoes or other items which have laces, ropes, strings and alike which need fastening. It can be used to fasten shoe laces simply by inserting the shoe laces into the BLFD and pulling them. The locking mechanism of the BLFD has two positions: "closed" and "opened". In the closed position the device works as a lace ratchet i.e. allowing the lace to be pulled forwards but blocking any lace motion backwards. After the user has fastened the laces they remain fastened until the locking mechanism is switched into an opened position. The principle of operation of the device is by using a separate channel for each of the laces. A resilient gate is installed in each channel. The gate is resilient, flat and has a front end which has a sharp edge. The gates are installed diagonally in each of the channels. The lace passes in a gap between the front end of the gate and the channel's wall opposite to the front end of the gate. The gap width is controlled by a locking mechanism. When the locking mechanism is in closed position the gap is narrowed such that the gate is squeezing the lace in the channel with its sharp edge and acts as a lace ratchet. It means that the gate allows forward fastening motion of the lace but blocks any lace motion in backward direction. The ratchet operation of the gate stems from the forward leaning diagonal position of the gate, which allows forward lace motion when it is bended forwards but blocks backward lace motion when it is bended backwards. When the locking mechanism is switched into opened position the gap is widened enough such that the lace can be released because it can move freely in the channel.

The BLFD has many advantages over previous devices primarily due to its efficient and easy fastening operation by a ratchet mechanism which requires the user just to pull the lace. Once the lace is pulled, it remains fastened until the locking mechanism is switched from closed position into opened position whereby it disables the ratchet mechanism and releases the lace. Another advantage of our BLFD is the ability to switch the locking mechanism by one hand motion and it remains in closed or in opened position until the user switches it back. This feature allows operating the BLFD with just one hand.

INTRODUCTION

Device Structure and Method of Operation

The Buckle-Lace (BuckLace) Fastening Device (BLFD) is a device which enables to fasten shoe laces and any other laces, chords, ropes, strings and alike. In the following sections we shall refer to: shoe laces, laces, chords, ropes, strings and alike by the term: "lace". The BLFD has channels in which the laces are passing. The BLFD has a locking mechanism with two positions: "opened" and "closed". In the "closed" position, the locking mechanism enables the user to fasten the laces by pulling them and also keeps the laces fastened when the pulling stops. In the opened position the locking mechanism enables to release the previously fastened laces.

The modus operandi of the BLFD's locking mechanism is to control the width of the gaps through which the laces are passing. These gaps exist between the front ends of Gates which are installed in each cannel and the walls of the channels which are opposite to the front ends. It means that each Gate has a front end which has a small gap between it and an opposite channel wall. The locking mechanism is able to widen or narrow all the gaps of the BLFD simultaneously. When the locking mechanism narrows the gaps it activates in each Gate a ratchet structure which allows lace motion in forward direction but prevents lace motion backwards. We shall explain the principle of operation of the ratchet structure in following paragraphs. When the user of the BLFD switches the locking mechanism into the opened position it widens the gaps. When the gaps are widened they no longer have ratchet structures and the laces are released because they are free to move backwards as well as forwards.

The Buckle-Lace Fastening Device (BLFD) has laces which pass via channels. Each channel must have a wall opposite to the front ends of the Gates installed in the channel. But the other walls are optional: an optional attachment wall (or a post) and side walls depending on the channel's shape. The walls could be curved or straight depending on each application requirements. Each of the Gates installed in the channels of the Buckle-Lace Fastening Device (BLFD) has a 3D shape which could be enveloped by a convex hull which has an approximate 3D shape of a planar plate wherein the plate's width and length are substantially greater than its thickness. We prefer to define the Gates' shapes by their convex hulls because it allows the Gates to have a variety of shape variations yet all of these variations are substantially flat because they are constrained by convex hulls which have approximate shapes which resemble planar plates.

Each of the Gates has a front end and a rear end. Each of the Gates is installed in the channel in a forward leaning diagonal direction with respect to the forward direction of the channel. The forward direction of the channel is defined as the direction from the entry opening of the channel to the exit opening of the channel. A Gate with a forward leaning diagonal direction has the following properties: the front end of the Gate is closer to the exit opening of the channel than the rear end and also the front end of the Gate is closer to the opposite wall than the rear end of the Gate (forward leaning diagonal gates are illustrated in FIG. 1, FIG. 5 and FIG. 7). The Gate has a front end which is quite flat and thin (sharp like a dull blade) and a rear end which is approximately parallel to the front end but does not need to be as thin. The locking mechanism of the BLFD has two positions. In the closed position, the locking mechanism narrows the gap in which the lace passes. The Gap is narrowed such that the lace is squeezed between the Gate's front end and the Channel's opposite wall. In the opened position, the gap is widened more than the lace's width.

We propose two options to the operation and structure of the Gates in the BLFD. The first option, we name as: "Resilient Gate" and the second option we name as: "Solid Gate". The Resilient Gates (named as: "flexible member" in our previous Provisional patents on Lace fastening devices) can be bended by forces applied to their front end and they return to their original shapes when the forces subside or are removed. The Resilient Gates are made of resilient and flexible materials such as: steel, Teflon, bronze, etc. The Resilient Gates have flat, planar structures which enables them to bend forward and backward perpendicularly to the plane approximating their flat structure. Each Resilient Gate is installed with its plane in forward leaning diagonal direction with respect to the channel's forward direction, which usually coincides with the direction of the lace passing through the channel (illustrated in FIGS. 1, 5, 7). Usually the lace direction is parallel to the opposite wall on which it lies. Each Resilient Gate has two ends. The rear end of each Resilient Gate is attached to a post which is connected to the upper part of the channel. We shall name them henceforward as "posts". Each Resilient Gate has a gap between its front end and the wall opposite to it (named as "opposite wall").

Since each Resilient Gate has only one end which is attached to a post, their front end is free to move when the Resilient Gate bends. Due to the forward leaning diagonal installation of the resilient Gates, their front end is in forward direction with respect to their rear end. Due to the resilient Gates' forward leaning diagonal positions in the channels, when a resilient Gate is bent its unattached front end is free to move in the channel either in a combined forwards plus lateral inwards direction (inward direction is the direction away from the opposite wall) or in a combined backwards plus laterally outward direction i.e. towards the opposite wall. Thus, when the Gates' front ends are dragged forwards by their laces they also move laterally inwards, i.e. away from their opposite walls. This motion widens the gaps between their front ends and their opposite walls and allows the gate's dragging lace to move forward. On the other hand, when the front ends are dragged backwards by their laces, they also move laterally outwards, i.e. towards their opposite walls. This motion narrows the gaps between their front ends and their opposite walls. The narrowed gap blocks the backward motion of the gates' dragging laces.

The principle of operation of the ratchet structure is founded on these two combined motions. When the locking mechanism is in the closed position it is narrowing the gaps such that the laces are squeezed between the Gates' front ends and their opposite walls. When the laces are dragged forwards, they drag in forward direction also the front ends of the Resilient Gates because the laces are pressed against their front ends. This forward motion of the front ends is combined with lateral inwards motion component, which moves the front ends away from their opposite walls. The motion away from their opposite walls widens their Gaps, thus allowing even easier additional lace motion forwards. When the laces move in forward direction the laces are in fastening mode.

On the other hand, when the locking mechanism is in closed position and when the laces are dragged backwards they drag also the front ends in combined backwards and outwards directions. The front ends' motion outwards (i.e. motion towards their opposite walls) squeezes the laces even more against their opposite walls and this blocks the laces, preventing any additional motion backwards. Thus, the principle of the ratchet operation: allowing laces motion only forwards and blocking their motion backwards.

However, when the locking mechanism is in opened position, it widens the gaps such that the laces are not squeezed between their front ends and their opposite walls. Thus, in the opened position the ratchet operations are eliminated and the laces are free to move backwards and forwards. So switching the locking mechanism from closed position to opened position switches the BLFD from fastening mode into releasing its laces.

The second Gate option is named as "Solid Gate". Solid Gates could be made of rigid materials such as: steel, brass, rigid plastics, etc. Solid Gates also have straight, sharp and narrow front ends which also squeeze the laces in gaps against their opposite walls (see in FIGS. 11 and 12). But the motion of their front ends are achieved not by bending but by rotation around pivots installed in the channels. Each Solid Gate is mounted on a pivot near the Solid Gate's rear end and the pivot axis is parallel to its Gate's front end. Each Solid Gate is installed in a forward leaning diagonal direction with respect to the channel's forward direction such that its front end is nearer than its rear end to the exit opening of the channel and also its front end is nearer than its rear end to its opposite wall. Each Solid Gate is equipped with a spring which has a bias which tends to rotate the Gate's front end towards its opposite wall (i.e. in combined backwards and outwards directions), thus narrowing the gap. The locking mechanism of the Solid Gates also has closed and opened positions. In the closed position, the locking mechanism disengages from Solid Gates and allows the Solid Gates' springs to squeeze the laces in their gaps. When the laces are being squeezed, the Solid Gate has a ratchet operation on the laces the same way as the Resilient Gates' ratchet operation. In the opened position, the locking mechanism rotates the Solid Gates in combined forwards and inwards directions i.e. against their springs' bias. This widens the gaps and eliminates the ratchet operation. In the opened position the laces are released since they are free to move in both forwards and backwards directions.

The locking mechanism of the BLFD in the Resilient Gate option is actually a mechanism which widens or narrows the front ends' gaps by either by moving the Gates' posts with respect to their opposite walls, or by moving the opposite walls with respect to their Gates' posts. In the first option, i.e. the Resilient Gate option of this invention we describe an embodiment (in FIGS. 1-8) in which the locking mechanism is moving the Gates' posts. The locking mechanism of the BLFD has two positions. In the closed position the channels are narrowed such that the gaps between the front ends of the Resilient Gates with their opposite walls become narrow enough such that the laces are squeezed between the Resilient Gates' front ends and their opposite walls. In the opened position of the locking mechanism moves the Gates' front ends away from the opposite walls such that the gaps between the front ends of the Resilient Gates and their opposite walls are widened enough such that the laces can move freely in the gaps.

Each Resilient Gate has a flexible and resilient structure such that when it bends, its front end can move diagonally in two directions: either in a combined forwards direction plus laterally inwards direction (away from the opposite walls) or in a combined backwards direction plus laterally outwards direction (i.e. towards the opposite wall). When the BLFD is in the "closed" position and the laces are moved forwards, the front end of each Resilient Gate is also dragged forwards because each front end is squeezing a lace in its gap. Since the Resilient Gates are installed diagonally, when their front ends move forwards they also move laterally—away from the opposite walls thereby widening their gaps to their opposite walls. A wider gap allows the lace to move more freely in forward direction. When the BLFD is in the closed position and the laces are moved in backward direction they drag the front end of each Resilient Gate backwards. This narrows the front end's gap since each Resilient Gate, which is installed diagonally, also moves laterally outwards—i.e. towards the opposite wall when its front end moves backwards. Thus, a backwards movement of the lace is very limited because it only narrows the gap and squeezes the lace in the gap even more. Hence, when the locking mechanism is in closed position, the BLFD is a ratchet fastening device because laces that were pulled in forward direction for fastening remain fastened when the pulling stops because their motion in backward direction is blocked.

When the user wants to release fastened laces all that is required is to switch the locking mechanism into an opened position. In the opened position the gaps between the Resilient Gates front ends and their opposite walls are widened and the laces can move freely in the channel because they are not blocked by the Resilient Gates since their gaps from their opposite walls are larger than the laces' widths. Thus, switching the locking mechanism into opened position releases fastened laces immediately.

BRIEF DESCRIPTION OF THE DRAWINGS

FIGS. 9, 10 describe a cross section of a channel with a Resilient Gate in closed and opened positions. FIGS. 11 and 12 illustrate a cross section of a channel with a Solid Gate in closed and opened positions.

FIGS. 1 and 2 describe by isometric drawing the upper and the lower parts of a two-channel BLFD respectively. FIG. 3 illustrates an isometric drawing of the BLFD in an opened position of the locking mechanism. FIG. 3 also includes two laces installed in the BLFD's two channels. FIG. 4 describes the same two-channel BLFD in the closed position of the locking mechanism, including two laces as well. FIG. 5 illustrates 3 projections of the upper part of the BLFD. FIG. 6 illustrates 3 projections of the lower part of the BLFD. FIG. 7 describes a cross section of the BLFD in the closed position. FIG. 7 is quite important for the understanding of the lace fastening mechanism of the BLFD since it illustrates the resilient gate while squeezing the lace in the gap. FIG. 8 describes a cross section of the BLFD in the opened position. FIG. 8 is quite important for the understanding of the lace releasing operation by the locking mechanism of the BLFD.

DETAILED DESCRIPTION OF THE DRAWINGS

Figure 7:
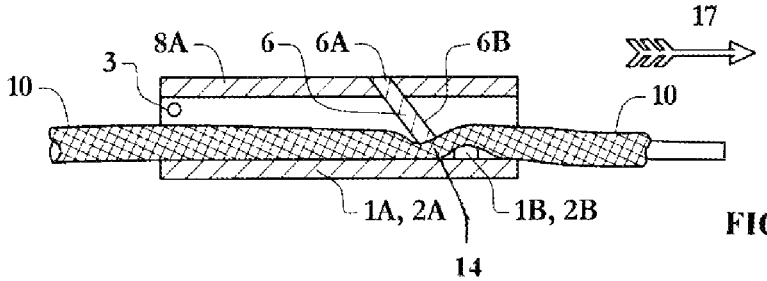
Figure 8:
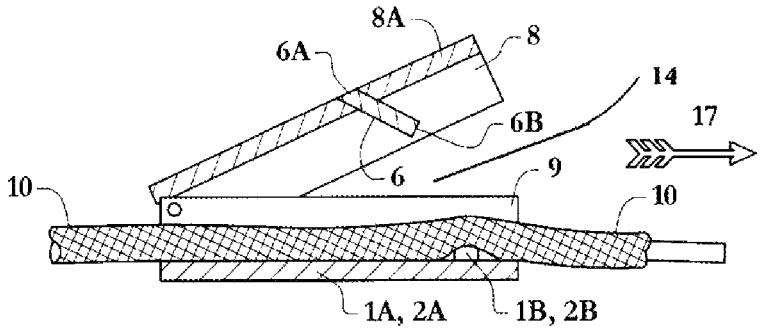
Figure 9:
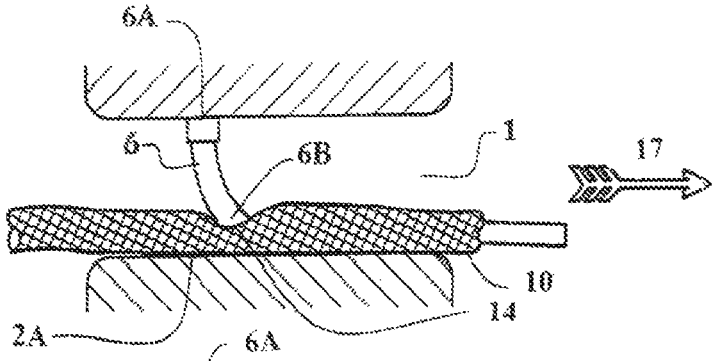
In FIGS. 9, 10, 11, 12, we present drawings of simplified cross sections of channels with two kinds of Gates: Resilient Gate and Solid Gate in order to explain their principles of operation. The locking mechanism described in FIGS. 1, 2, 3, 4, 5, 6, 7, and 8 is absent in FIGS. 9, 10, 11, 12 because they are purposely simplified and drawn primarily with the objective to explain the operation principles of the ratchet structure of the BLFD for Resilient and Solid Gates.
Figure 10:
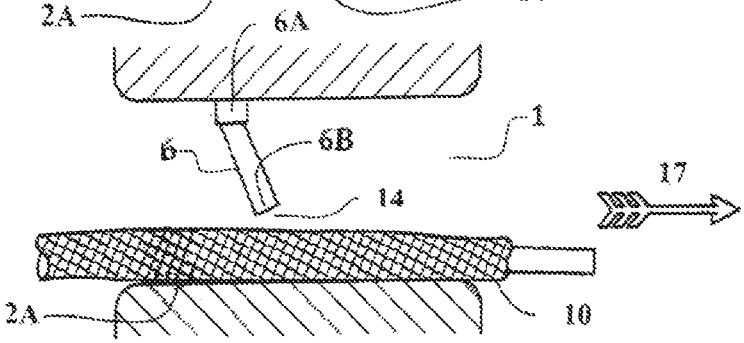

We prefer to discuss FIGS. 9, 10, 11, 12 first because they illustrate the principles of operation of the BLFD. In FIGS. 9, 10, 11, 12, we present drawings of simplified cross sections of channels with two kinds of Gates: Resilient Gate and Solid Gate in order to explain their principles of operation. The locking mechanism described in FIGS. 1, 2, 3, 4, 5, 6, 7 and 8 is absent in FIGS. 9, 10, 11, 12, because they are purposely simplified and drawn primarily with the objective to explain the operation principles of the ratchet structure of the BLFD for Resilient and Solid Gates. FIGS. 9 and 10 illustrate a cross section of the channel 1 of a BLFD with one Resilient Gate 6. In FIG. 9 the BLFD with its locking mechanism is in closed position in which the gap 14 between the front end 6B of the Resilient Gate 6 and the opposite wall 2A is narrower than the lace's width and therefore the lace 10 is squeezed between the front end 6B of the Resilient Gate 6 and the opposite wall 2A. As can be observed from FIG. 9, the Resilient Gate 6 is bending forward as a consequence of the squeezing force applied on the lace 10. The rear end 6A of the Resilient Gate 6 is attached to the channel by a post 6A. The Resilient Gate has a flat structure and is installed in forward leaning diagonal direction in which its front end 6B is placed at a forward location relative to the location of its rear end 6A. Also, its front end 6B is nearer to the opposite wall 2A than its rear end 6A. The forward direction in the channel is denoted by the arrow 17. At the locked position of the locking mechanism the lace can be moved only forwards and its backwards motion is blocked.

FIG. 10 describes the BLFD with one Resilient Gate 6 with its locking mechanism in an opened position in which the gap 14 between the front end 6B of the Resilient Gate 6 and the opposite wall 2A is wider than the lace 10 width and therefore the lace 10 is not squeezed between the front end 6B of the Resilient Gate 6 and the opposite wall 2A. Thus, at the opened position of the BLFD's locking mechanism, the lace can move freely in forward and backward directions.

When the BLFD is at the closed position, as illustrated in FIG. 9, and when the lace 10 is pulled to the right (i.e. in forward direction 17) the front end 6B of the Resilient Gate 6 also is dragged forwards. Since the Resilient Gate 6 is installed in a forward leaning diagonal orientation where its front end 6B is in forward location relative to its rear end 6A, dragging forwards the front end 6B also moves it inwards i.e. away from the opposite wall 2A which in turn widens its gap 14 to its opposite wall 2A. This enables the lace 10 to move forwards to the right.

Referring to FIG. 9, when the lace 10 is pulled to the left (i.e. in backwards direction in channel 1) the front end 6B of the Resilient Gate 6 is dragged also backwards. Since the Resilient Gate 6 is installed in a forward leaning diagonal orientation where its front end 6B is in forward location relative to its rear end 6A, dragging backwards the front end 6B also moves it outwards i.e. towards the opposite wall 2A which in turn narrows its gap 14 to its opposite wall 2A. Narrowing the gap 14 blocks the lace 10 motion backwards (to the left). Due to this ratchet structure, the lace 10 can be fastened by pulling it forwards (to the right) since it keeps being fastened when the pulling stops because its movement backwards (to the left) is blocked when the locking mechanism of the BLFD is in closed position. The lace 10 can be released when the locking mechanism is switched to opened position. At the opened position (described in FIG. 10) the gap 14 between the front end 6B and the opposite wall 2A becomes wider than the width of the lace 10 and the lace 10 is free to move in both directions.

Figure 11:
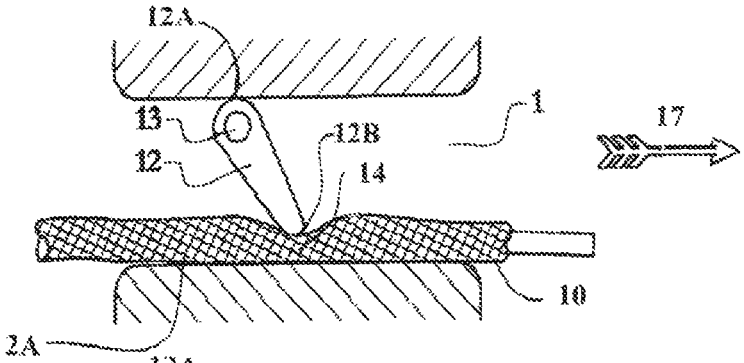
Figure 12:
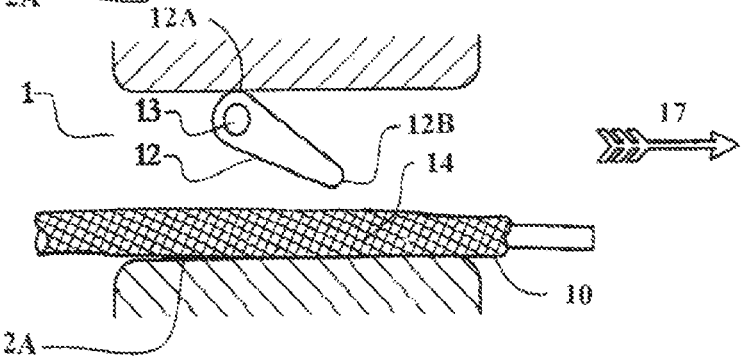

FIGS. 11 and 12 illustrate a cross section a channel 1 of a BLFD with a Solid Gate 12. In FIG. 11, the BLFD is with its locking mechanism in closed position in which the gap 14 between the front end 12B of the Solid Gate 12 and the opposite wall 2A is narrowed and therefore the lace 10 is squeezed between the front end 12B of the Solid Gate 12 and the opposite wall 2A. As can be observed from FIG. 11, to narrow the gap 14 into closed position, the locking mechanism of the BLFD has rotated the Solid Gate 12 in clockwise direction around its pivot 13. As consequence, the Solid Gate 12 narrows the gap 14 between its front end 12B and its opposite wall 2A which in turn applies a squeezing force on the lace 10. The rear end 12A of the Solid Gate 12 is attached to a pivot 13 which enables the Solid Gate to rotate around its pivot. The Solid Gate has a flat structure with sharp front end 12B and is installed diagonally where its front end 12B is placed at a forward location relative to the location of its rear end 12A. The forward direction in the channel is denoted by the arrow 17. The Solid Gate 12 does not have to be resilient and can be manufactured from solid material such as steel, brass, plastics, etc.

FIG. 12 describes the BLFD with one Solid Gate 12 with its locking mechanism in an opened position in which the Solid Gate 12 is rotated around its pivot 13 in counterclockwise direction. As a result, the gap 14 between the front end 12B of the Resilient Gate 12 and the opposite wall 2A is wider than the lace 10 width and therefore the lace 10 is not squeezed between the front end 12B of the Solid Gate 12 and the opposite wall 2A. Thus, at the opened position of the BLFD's locking mechanism, the lace can move freely in forward and in backward directions.

When the locking mechanism of the BLFD is at the closed position, as illustrated in FIG. 11, and when the lace 10 is pulled to the right (i.e. in forward direction 17) the front end 12B of the Solid Gate 12 also is dragged forwards. Since the Solid Gate 12 is installed in a forward leaning diagonal orientation where its front end 12B is in forward location relative to its rear end 12A (at the location of the pivot 13), dragging forwards the front end 12B also rotates it in counterclockwise direction around its pivot 13. Rotation of the front end 12B in counterclockwise direction also moves it away from the opposite wall 2A which in turn widens its gap 14 to its opposite wall 2A. This enables the lace to move forwards to the right.

Referring to FIG. 11, when the lace 10 is pulled to the left (i.e. in backwards direction in channel 1) the front end 12B of the Solid Gate 12 is dragged also backwards. Since the Solid Gate 12 is installed in a forward leaning diagonal orientation where its front end 12B is in forward location relative to its rear end 12A (at the location of the pivot 13), dragging backwards (to the left) the front end 12B also rotates it in clockwise direction around its pivot 13. Front end 12B rotation in clockwise direction also moves it towards the opposite wall 2A which in turn narrows its gap 14 to its opposite wall 2A. This blocks the lace 10 and prevents it from moving backwards to the left. Due to this ratchet structure, the lace 10 can be fastened by pulling it forwards (to the right) but it keeps being fastened when the pulling stops because its movement backwards (to the left) is blocked when the locking mechanism of the BLFD is in closed position. Referring to FIG. 12, the lace 10 can be released when the locking mechanism is switched to an opened position. At the opened position (described in FIG. 12) the Solid Gate is rotated in counterclockwise direction by the locking mechanism. As a result, the gap 14 at the front end 12B of the Solid Gate 12 becomes wider than the width of the lace 10 and the lace 10 is free to move in both directions.

Figure 6:
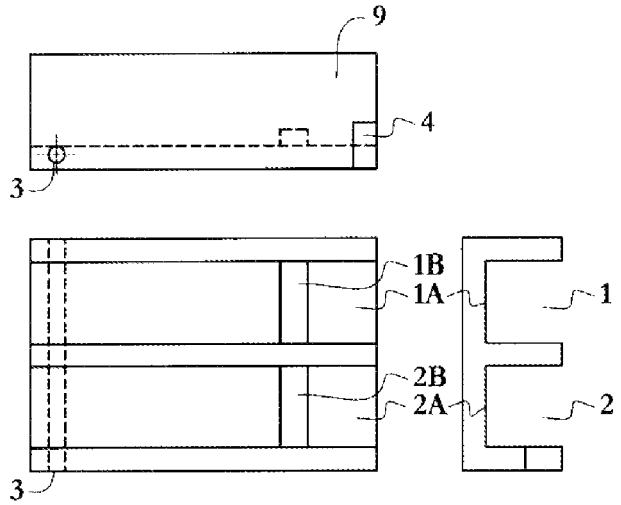

We want to comment here that it is possible to improve the blocking of laces 10 motions in backwards directions, by adding also protrusions (convexities) on the opposite walls 2A opposite to the front ends 12B. Such convexities enhance the lace 10 blocking force because they bend the squeezed laces 10 and thus increase the holding force of the Resilient Gates 6 and the Solid Gates 12. Such protrusions denoted by 1B and 2B are illustrated in FIGS. 6, 7 and 8.

Figure 1:
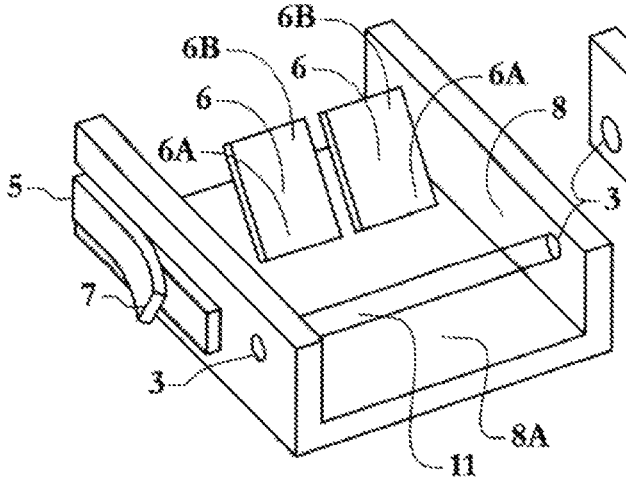
In FIGS. 1, 2, 3, 4, 5, 6, 7 and 8 we describe an embodiment of a two-channel BLFD with Resilient Gates. However, other embodiments could have other numbers of channels, laces, Resilient Gates, etc.
Figure 2:
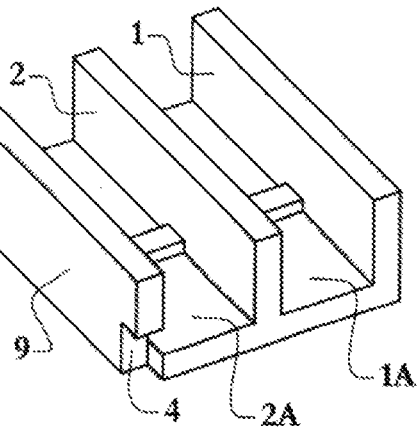
Figure 3:
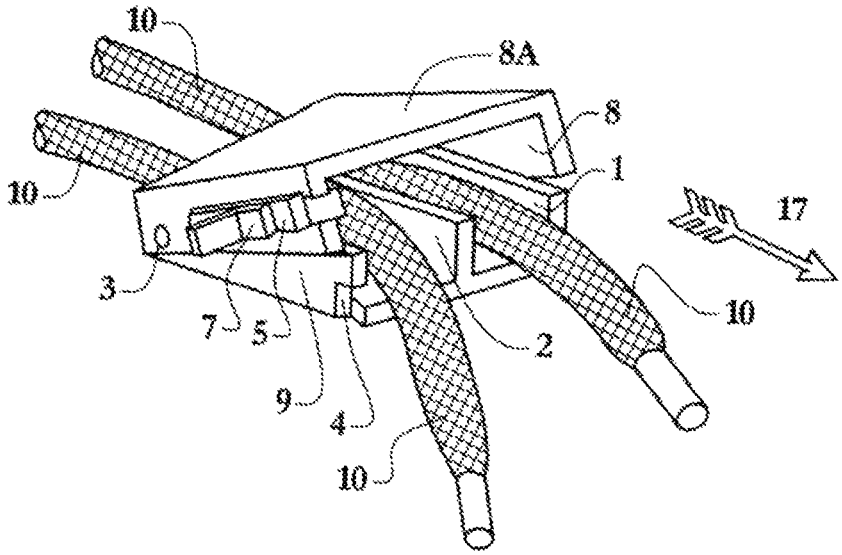
Figure 4:
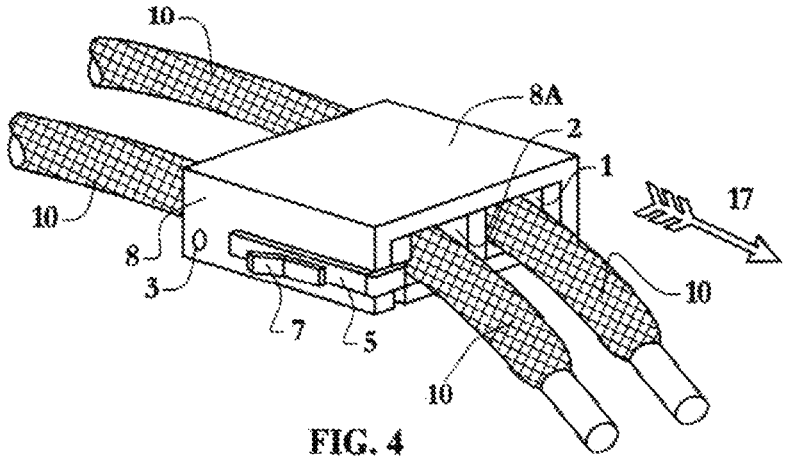
Figure 5:
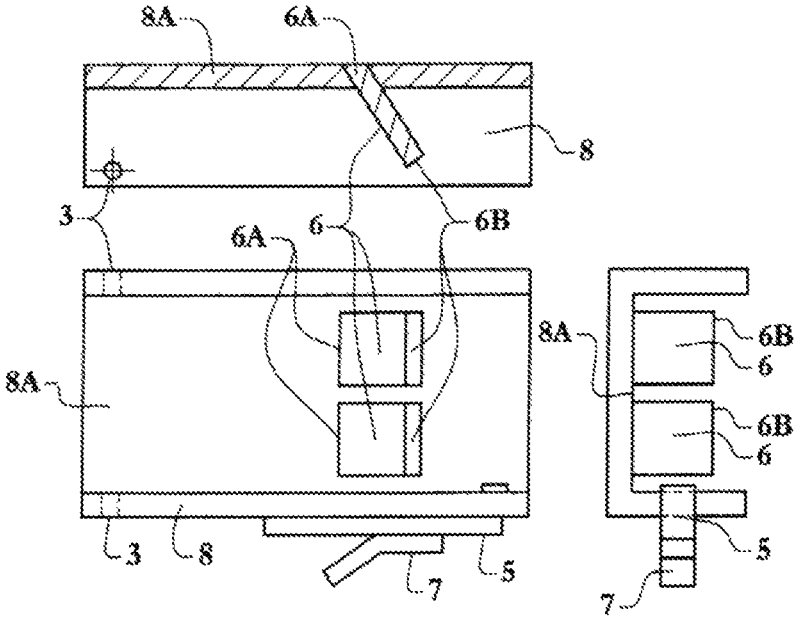

The upper part 8 of the BLFD is illustrated in FIG. 1. It has two circular holes 3 which serve as bearings which support the shaft 11. The lower part 9 of the BLFD, described in FIG. 2, also has two circular holes 3 in which the shaft 11 is installed when the two parts are assembled together. This configuration allows the upper part 8 to rotate relative to the lower part 9. The upper part 8 can swivel relative to the lower part in a limited angle of rotation of about 15 degrees. The locking mechanism of the BLFD is switched between opened and closed positions by rotating the upper part 8 relative to the lower part 9. When the upper part 8 is rotated to a parallel position relative to the lower part 9 as illustrated in FIGS. 4 and 7, the BLFD is in the closed position. In the closed position, the attachment wall 8A and its opposite walls 1A and 2A are parallel. With reference to FIGS. 3 and 8, when the upper part 8 swivels about 15 degrees in counterclockwise direction from the closed position, it moves to the opened position as illustrated in FIG. 8. The upper part 8 in FIG. 1, has two Resilient Gates 6 which are installed in a forward leaning diagonal position with respect to their attachment wall 8A. The plane 8A serves as the attachment walls of both channels 1 and 2 and the rear ends 6A of the Resilient Gates 6 are attached to the attachment wall 8A. The front ends 6B of the Resilient Gates 6 are free to move when the Resilient Gates 6 are bent. The two Resilient Gates 6 are fitted into the two channels 1 and 2 of the lower part 9 when the upper and the lower parts are in the closed position. As can be observed in FIGS. 1, 5, 7 and 8 the Resilient Gates 6 have flat structures and are installed in a forward leaning diagonal direction with respect to the forward direction of the channels 1 and 2 which is marked by arrow 17 in FIGS. 3, 4, 7 and 8.

FIGS. 3 and 8 describe the BLFD with its locking mechanism in opened position. FIGS. 4 and 7 describe the BLFD in the closed position. It can be observed from FIGS. 3 and 8 that in the opened position, the attachment planar wall 8A of the upper part 8 has been rotated in counterclockwise direction at about 15 degrees with respect to the opposite walls 1A and 2A of the lower part 9. In this position, the front ends 6B of the Resilient Gates 6 have large gaps 14 with their opposite walls 1A and 2A. At this position the laces 10 are free to move in forward and reverse directions.

When the BLFD is at the closed position, as illustrated in FIGS. 4 and 7, when the laces 10 are pulled to the right (i.e. in forward direction 17 in channels 1 and 2) the front ends 6B of the Resilient Gates 6 are dragged also forwards to the right. Since the Resilient Gates 6 are installed diagonally with respect to attachment wall 8A and opposite walls 1A and 2A, dragging the front ends 6B of the Resilient Gates 6 to the right widens their distance gaps 14 to their opposite walls 1A and 2A. This enables the laces to move forwards to the right.

Referring to FIG. 7, when the laces 10 are pulled to the left (i.e. in backwards direction in channels 1 and 2) the front ends 6B of the Resilient Gates 6 are dragged also to the left. Since the Resilient Gates 6 are installed diagonally with respect to attachment wall 8A and opposite walls 1A and 2A, dragging the front ends 6B of the Resilient Gates 6 to the left narrows their gaps 14 and blocks the laces 10 motion to the left. Due to this ratchet structure, the laces 10 can be fastened by pulling them to the right but they keep being fastened when the pulling stops because their movement backwards (to the left) is blocked when the BLFD is in closed position. As illustrated in FIG. 8 the laces 10 can be released when the locking mechanism is switched to opened position by rotating the upper part 8A in FIG. 8 counterclockwise. At the opened position the distance gaps 14 between the front ends 6B of Resilient Gates 6 and their opposite walls 1A and 2A become wider than the widths of the laces 10 and the laces 10 are free to move in both directions.

As illustrated in FIGS. 6, 7 and 8, in order to improve the blocking of laces 10 motions in the reverse directions, we added also the protrusions (bulges, convexities) 1B and 2B on the opposite walls 1A and 2A respectively. The convexities 1B and 2B are installed opposite to Resilient Gates front ends 6B. These convexities enhance the blocking force because they bend the squeezed laces 10 (as seen in FIG. 7) and thus increase the holding force of the Resilient Gates.

FIGS. 1, 3, 4, 5 and 6 describe the locking mechanism. The locking mechanism includes a lock 5 made of resilient material and a lever 7. The lock 5 is made of resilient material, it is L shaped and its long arm is partially attached to the upper part 8. Pressing the lever 7 bends the lock 5 outwards. In the closed position the lock 5 is inserted into the recess 4 in the lower part 9. When the lock 5 is in the recess 4 it locks the upper part such that its planar attachment wall 8A is parallel to the opposite walls 1A and 2A. In this position the BLFD is in closed position and the user can fasten the laces 10 by pulling them in forward direction 17 and they remain fastened.

When the user wants to release the fastened laces, the user presses on the lever 7 which bends the lock 5 outwards and removes it from the recess 4. When the lock 5 is removed from the recess 4 it unlocks the upper part from the lower part and allows the upper part to swivel about 15 degrees in counter-clockwise direction (as illustrated in FIGS. 3 and 8). When the upper part is swiveled it widens the gaps 14 between the front ends 6B of the Resilient Gates 6 and their opposite walls 1A and 2A. In this position the gaps 14 are wider than the widths of the laces 10. As a result, the BLFD moves into its opened position and the laces 10 are released.

The invention claimed is:

1. A buckle-lace fastening device for fastening laces, comprising a multiplicity of channels; wherein each said channel has an upper part and a lower part, said upper part is rotatably mounted on said lower part in which said upper part is able to turn with respect to said lower part; wherein each said channel has an entry opening and an exit opening; wherein a forward direction in each said channel is defined as the direction from said entry opening to said exit opening; wherein a backward direction in each said channel is defined as the direction from said exit opening to said entry opening; wherein each said channel has a resilient gate; wherein said resilient gate is made of a resilient and flexible material; wherein said resilient gate has a rear end and a front end; wherein said resilient gate is attached to said channel by attaching said rear end to said upper part of said channel and leaving said front end unattached; wherein each said lower part of said channel has an opposite wall situated opposite said front end; wherein said resilient gate is installed at a predetermined diagonal direction with respect to said forward direction; wherein at said diagonal direction said front end is closer to said exit opening than said rear end; wherein at said diagonal direction said front end is closer to said opposite wall than said rear end; wherein a gap exists between said front end of said resilient gate and said opposite wall of said lower part; wherein a force applied to said front end in said forward direction can move said front end in combined forwards plus laterally inwards directions by bending said resilient gate; wherein a force applied to said front end in said backward direction can move said front end in combined backwards plus laterally outwards directions by bending said resilient gate; wherein said gap can be widened and narrowed by a locking mechanism; wherein said locking mechanism has an opened position and a closed position; wherein at said opened position said gap is wide enough to allow said lace passing through said gap to move freely both in said forward direction and in said backward direction; wherein at said closed position said gap is narrower than a width of said lace, thereby said lace passing through said gap is being squeezed between said front end of said resilient gate and said opposite wall; wherein said front end can be moved towards or away from said opposite wall when said upper said upper part is turned towards or away with respect to said lower part, respectively, thereby narrowing or widening said gap, respectively; wherein said locking mechanism switches from said opened position into said closed position by turning said upper part towards said lower part such that said front end moves towards said opposite wall, thereby narrowing said gap more than said width of said lace such that said lace passing through said gap is squeezed between said front end and said opposite wall; and wherein said locking mechanism switches from said closed position into said opened position by turning said upper part away from said lower part such that said front end moves away from said opposite wall, thereby widening said gap more than said width of said lace such that said lace passing through said gap can be moved freely in said backward direction and in said forward direction.

2. The buckle-lace fastening device of claim 1, wherein when said locking mechanism is in said closed position, then moving in said forward direction said lace, which is squeezed in said gap also applies force which drags forward said front end which is squeezing said lace; wherein dragging forward said front end causes said front end to move in combined forwards plus laterally inwards directions; wherein said laterally inwards motion component of said front end moves said front end away from its said opposite wall; thereby widening said front end's said gap and allowing easier forward motion of said lace; wherein when said locking mechanism is in said closed position, then moving in said backward direction said lace, which is squeezed in said gap also applies force which drags backwards said front end which is squeezing said lace; wherein dragging backwards said front end causes said front end to move in combined backwards plus laterally outwards directions; wherein said laterally outwards motion component of said front end moves said front end towards its said opposite wall thereby narrowing said front end's said gap; thereby squeezing said lace even harder and blocking of any additional backwards motion of said lace; wherein when said locking mechanism is in said opened position, said gap is wider than said width of said lace; thereby said lace passing in said gap can move freely both in said forward direction and in said backward direction.

3. The buckle-lace fastening device of claim 1, wherein said locking mechanism comprises a locking arm which is made of a resilient material; said locking arm is installed on said upper part; wherein, when said locking mechanism is in said closed position, said locking arm fits into a recess in said lower part and locks together said upper part with said lower part; wherein said locking mechanism can be switched from said closed position into said opened position by unlocking said upper part from said lower part by pulling said locking arm out of said recess; thereby separating said upper part from said lower part by turning said upper part away from said lower part; wherein said locking mechanism can be switched from said opened position into said closed position by turning said upper part towards said lower part and locking said upper part with said lower part by pushing said locking arm into said recess.

4. The buckle-lace fastening device of claim 1, wherein each said opposite wall has at least one convexity which enables additional bending of said lace when said lace is squeezed between said front end of said resilient gate and said opposite wall, thereby increasing a lace's motion blocking force when said lace is pulled in said backwards direction.

5. The buckle-lace fastening device of claim 1, wherein each said resilient gate is made of a resilient flat plate.

6. The buckle-lace fastening device of claim 1, wherein each said front end of said resilient gate has a sharp edge which enables said front end to apply a concentrated squeezing pressure on said lace when said gap is narrowed below said width of said lace.

7. The buckle-lace fastening device of claim 1, wherein said upper part is rotatably mounted on said lower part using a shaft which is fitted into a bearing.

8. A buckle-lace fastening device for fastening laces, comprising a channel; wherein said channel has an upper part and a lower part, said upper part is rotatably mounted on said lower part in which said upper part is able to turn with respect to said lower part; wherein said channel has an entry opening and an exit opening; wherein a forward direction in said channel is defined as the direction from said entry opening to said exit opening; wherein a backward direction in said channel is defined as the direction from said exit opening to said entry opening; wherein said channel has a resilient gate; wherein said resilient gate is made of a resilient and flexible material; wherein said resilient gate has a rear end and a front end; wherein said resilient gate is attached to said channel by attaching said rear end to said upper part of said channel and leaving said front end unattached; wherein said lower part of said channel has an opposite wall situated opposite to said front end; wherein said resilient gate is installed at a predetermined diagonal direction with respect to said forward direction; wherein at said diagonal direction said front end is closer to said exit opening than said rear end; wherein at said diagonal direction said front end is closer to said opposite wall than said rear end; wherein a gap exists between said front end of said resilient gate and said opposite wall of said lower part; wherein a force applied to said front end in said forward direction can move said front end in combined forwards plus laterally inwards directions by bending said resilient gate; wherein a force applied to said front end in said backward direction can move said front end in combined backwards plus laterally outwards directions by bending said resilient gate; wherein said gap can be widened and narrowed by a locking mechanism; wherein said locking mechanism has an opened position and a closed position; wherein at said opened position said gap is wide enough to allow said lace passing through said gap to move freely both in said forward direction and in said backward direction; wherein at said closed position said gap is narrower than width of said lace, thereby said lace passing through said gap is being squeezed between said front end of said resilient gate and said opposite wall; wherein said front end can be moved towards or away from said opposite wall when said upper said upper part is turned towards or away with respect to said lower part, respectively, thereby narrowing or widening said gap, respectively; wherein said locking mechanism switches from said opened position into said closed position by turning said upper part towards said lower part such that said front end moves towards said opposite wall, thereby narrowing said gap more than said width of said lace such that said lace passing through said gap is squeezed between said front end and said opposite wall; and wherein said locking mechanism switches from said closed position into said opened position by turning said upper part away from said lower part such that said front end moves away from said opposite wall, thereby widening said gap more than said width of said lace such that said lace passing through said gap can be moved freely in said backward direction and in said forward direction.

9. The buckle-lace fastening device of claim 8, wherein when said locking mechanism is in said closed position, then moving in said forward direction said lace, which is squeezed in said gap also applies force which drags forward said front end which is squeezing said lace; wherein dragging forward said front end causes said front end to move in combined forwards plus laterally inwards directions; wherein said laterally inwards motion component of said front end moves said front end away from its said opposite wall; thereby widening said front end's said gap and allowing easier forward motion of said lace; wherein when said locking mechanism is in said closed position, then moving in said backward direction said lace, which is squeezed in said gap also applies force which drags backwards said front end which is squeezing said lace; wherein dragging backwards said front end causes said front end to move in combined backwards plus laterally outwards directions; wherein said laterally outwards motion component of said front end moves said front end towards its said opposite wall thereby narrowing said front end's said gap; thereby squeezing said lace even harder and blocking of any additional backwards motion of said lace; wherein when said locking mechanism is in said opened position, said gap is wider than said width of said lace; thereby said lace passing in said gap can move freely both in said forward direction and in said backward direction.

10. The buckle-lace fastening device of claim 8, wherein said locking mechanism comprises a locking arm which is made of a resilient material; said locking arm is installed on said upper part; wherein, when said locking mechanism is in said closed position, said locking arm fits into a recess in said lower part and locks together said upper part with said lower part; wherein said locking mechanism can be switched from said closed position into said opened position by unlocking said upper part from said lower part by pulling said locking arm out of said recess; thereby separating said upper part from said lower part by turning said upper part away from said lower part; wherein said locking mechanism can be switched from said opened position into said closed position by turning said upper part towards said lower part and locking said upper part with said lower part by pushing said locking arm into said recess.

11. The buckle-lace fastening device of claim 8, wherein said opposite wall has at least one convexity which enables additional bending of said lace when said lace is squeezed between said front end of said resilient gate and its said opposite wall; thereby increasing a lace's motion blocking force when said lace is pulled in said backwards direction.

12. The buckle-lace fastening device of claim 8, wherein said resilient gate is made of a resilient flat plate.

13. The buckle-lace fastening device of claim 8, wherein each said front end of said resilient gate has a sharp edge which enables said front end to apply a concentrated squeezing pressure on said lace when said gap is narrowed below said width of said lace.

14. The buckle-lace fastening device of claim 8, wherein said upper part is rotatably mounted on said lower part using a shaft which is fitted into a bearing.

15. A buckle-lace fastening device for fastening laces, comprising a multiplicity of channels; wherein each said channel has an upper part and a lower part, said upper part is rotatably mounted on said lower part in which said upper part is able to turn with respect to said lower part; wherein each said channel has an entry opening and an exit opening; wherein a forward direction in each said channel is defined as the direction from said entry opening to said exit opening; wherein a backward direction in each said channel is defined as the direction from said exit opening to said entry opening; wherein each said channel has a multiplicity of resilient gates; wherein each said resilient gate is made of a resilient and flexible material; wherein each said resilient gate has a rear end and a front end; wherein each said resilient gate is attached to said channel by attaching its said rear end to said upper part of said channel and leaving its said front end unattached; wherein each said lower part of said channel has an opposite wall situated opposite to said front end; wherein said each resilient gate is installed at a predetermined diagonal direction with respect to said forward direction; wherein at said diagonal direction said front end is closer to said exit opening than said rear end; wherein at said diagonal direction said front end is closer to said opposite wall than said rear end; wherein a gap exists between said front end of said resilient gate and said opposite wall of said lower part; wherein a force applied to said front end in said forward direction can move said front end in combined forwards plus laterally inwards directions by bending said resilient gate; wherein a force applied to said front end in said backward direction can move said front end in combined backwards plus laterally outwards directions by bending said resilient gate; wherein said gap can be widened and narrowed by a locking mechanism; wherein said locking mechanism has an opened position and a closed position; wherein at said opened position said gap is wide enough to allow said lace passing through said gap to move freely both in said forward direction and in said backward direction; wherein at said closed position said gap is narrower than said width of said lace, thereby said lace passing through said gap is being squeezed between said front end of said resilient gate and said opposite wall; wherein said front end can be moved towards or away from said opposite wall when said upper said upper part is turned towards or away with respect to said lower part, respectively, thereby narrowing or widening said gap, respectively; wherein said locking mechanism switches from said opened position into said closed position by turning said upper part towards said lower part such that said front end moves towards said opposite wall, thereby narrowing said gap more than said width of said lace such that said lace passing through said gap is squeezed between said front end and said opposite wall; and wherein said locking mechanism switches from said closed position into said opened position by turning said upper part away from said lower part such that said front end moves away from said opposite wall, thereby widening said gap more than said width of said lace such that said lace passing through said gap can be moved freely in said backward direction and in said forward direction.

16. The buckle-lace fastening device of claim 15, wherein when said locking mechanism is in said closed position, then moving in forward direction said lace, which is squeezed in said gap also applies a force which drags forward said front end which is squeezing said lace; wherein dragging forwards said front end causes said front end to move in combined forwards plus laterally inwards directions; wherein said laterally inwards motion component of said front end moves said front end away from its said opposite wall; thereby widening said gap and allowing easier forward motion of said lace; wherein when said locking mechanism is in said closed position, then moving in said backward direction said lace, which is squeezed in said gap also applies force which drags backwards said front end which is squeezing said lace; wherein dragging backwards said front end causes said front end to move in combined backwards plus laterally outwards directions; wherein said laterally outwards motion component of said front end moves said front end towards its said opposite wall thereby narrowing said gap; thereby squeezing said lace even harder and blocking of any additional backwards motion of said lace; wherein when said locking mechanism is in said opened position, said gap is wider than said width of said lace; thereby said lace passing in said gap can move freely both in said forward direction and in said backward direction.

* * * * *